US005277139A

United States Patent [19]

Honeycutt

[11] Patent Number: 5,277,139

[45] Date of Patent: Jan. 11, 1994

[54] SEWING APPARATUS

[76] Inventor: Larry W. Honeycutt, P.O. Box 86, Concord, N.C. 28026

[21] Appl. No.: 723,798

[22] Filed: Jul. 1, 1991

[51] Int. Cl.[5] ..... D05B 21/00; D05B 27/00

[52] U.S. Cl. ..... 112/121.12; 112/152; 112/DIG. 2; 26/84

[58] Field of Search ..... 112/121.11, 121.12, 112/121.15, 121.27, 130, 152, 63, 262.2, DIG. 2; 198/468.2; 66/148; 26/80, 81, 82, 83, 84

[56] References Cited

U.S. PATENT DOCUMENTS

| | | | |
|---|---|---|---|
| 2,391,547 | 12/1945 | Cohn et al. | 26/84 |
| 2,507,599 | 5/1950 | Johnson | 26/84 |
| 2,826,802 | 3/1958 | Beard | 26/83 X |
| 3,978,557 | 9/1976 | Goodson | 26/84 |
| 4,267,785 | 5/1981 | Osho | 112/121.12 |
| 4,485,749 | 12/1984 | Gazzarrini | 112/121.12 |
| 4,519,327 | 5/1985 | Selvi | 112/121.15 |
| 4,598,817 | 7/1986 | Bell | 198/468.2 |
| 4,784,070 | 11/1988 | Thurner et al. | 112/121.12 |
| 4,957,051 | 9/1990 | Maegawa et al. | 112/121.12 |
| 5,040,475 | 8/1991 | Fournier et al. | 112/262.2 X |

FOREIGN PATENT DOCUMENTS

| | | | |
|---|---|---|---|
| 61-56687 | 3/1986 | Japan | 112/262.2 |

*Primary Examiner*—Peter Nerbun

*Attorney, Agent, or Firm*—Rhodes, Coats and Bennett

[57] ABSTRACT

A sewing apparatus and method for receiving tubular knit fabric from a pre-knitted roll and making the fabric into foot covers. The fabric is first passed through an unique spreader which is mounted at the end of a pivotal boom adjacent a sewing machine. A gripping head advances to the spreader and grips the portion of the fabric held by the spreader. The gripping head than withdraws a predetermined length of fabric from the pre-knitted roll through the spreader. An air jet blows the free end of the length of tubular knit fabric into a vacuum take-off tube connected to a gathering box. The pivotal boom then swings toward the sewing machine. As the pivotal boom completes it swing, the tubular knit fabric is fed to the sewing machine which simultaneously sews the end immediately adjacent the spreader, cuts the free end from the pre-knitted roll, and gathers the finished product in the take-off tube. The pivotal boom then returns to its starting position and the cycle repeats, thereby forming a number of short, closed end lengths suitable as foot covers.

12 Claims, 4 Drawing Sheets

FIG. 4
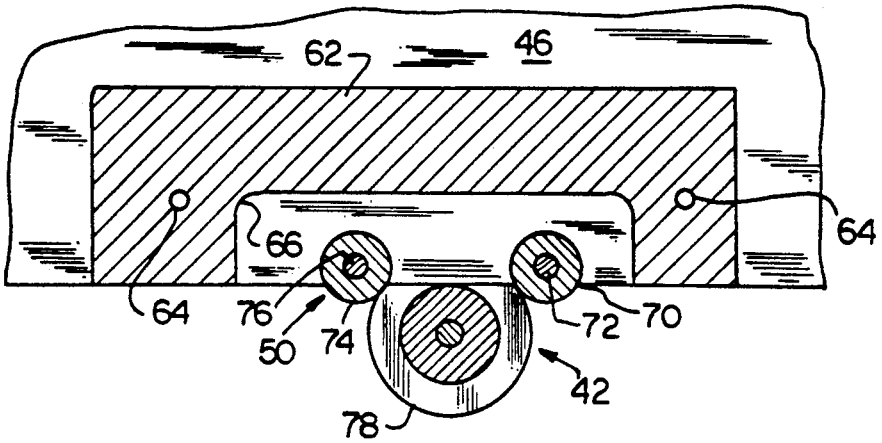
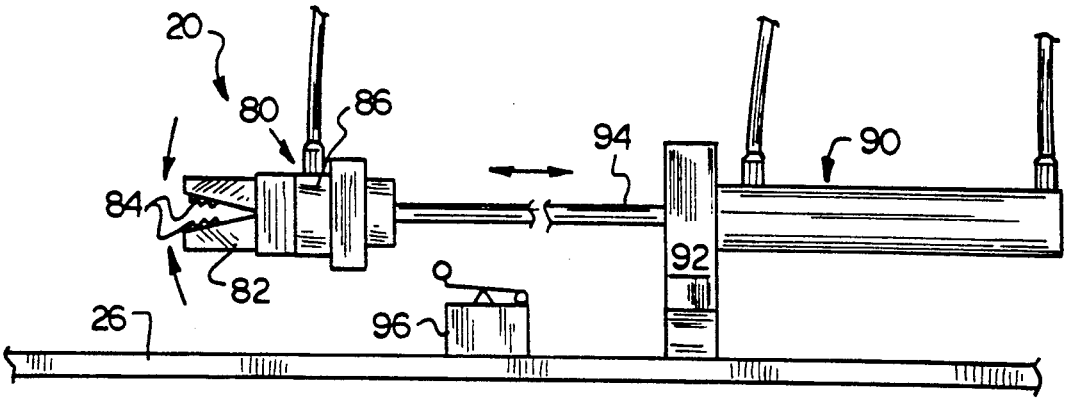
FIG. 5

FIG. 6
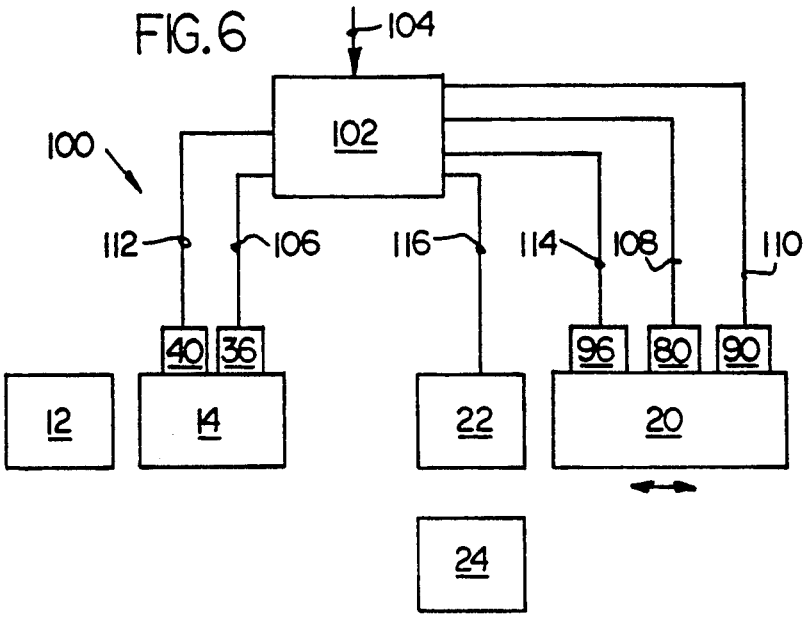
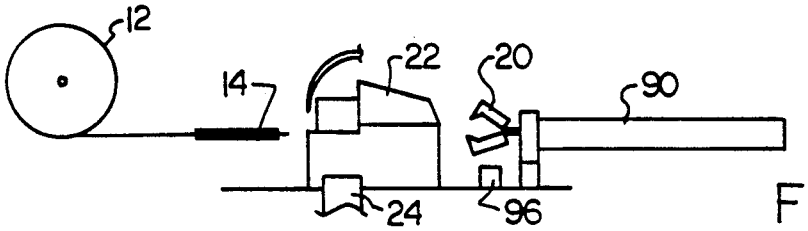
FIG. 7A
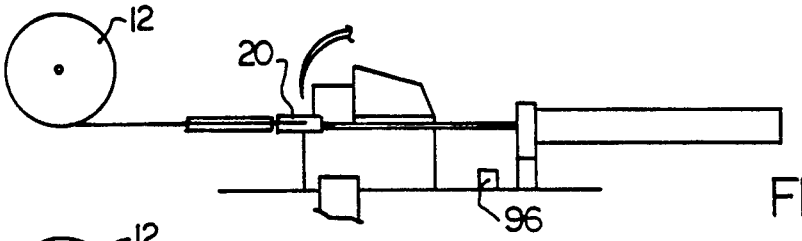
FIG. 7B
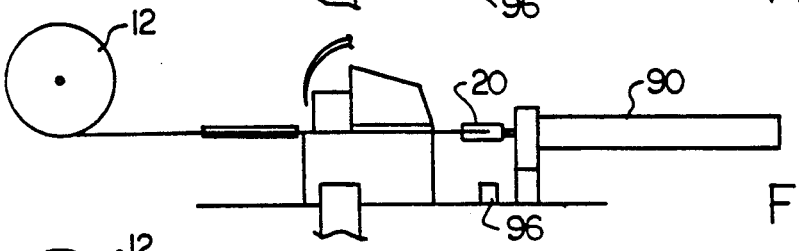
FIG. 7C
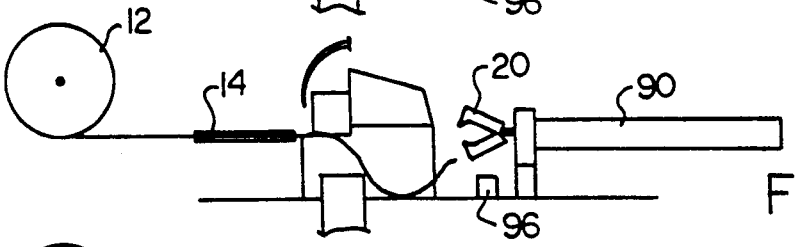
FIG. 7D
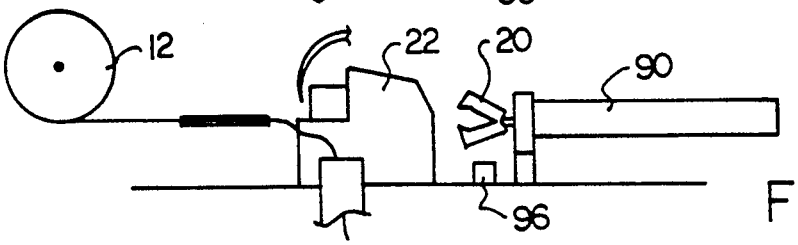
FIG. 7E

SEWING APPARATUS

BACKGROUND OF THE INVENTION (1) Field of the Invention

The present invention relates generally to automatic sewing apparatuses and, more particularly, to an apparatus and method for automatically withdrawing a length of tubular knit fabric from a pre-knitted roll to form a hosiery blank, closing the toe portion of the blank, and removing the sewn blank from the machine.

(2) Description of the Prior Art

In the manufacturing of knitted foot covers it is conventional practice first to manually withdraw a length of tubular knit fabric from a pre-knitted roll. A portion of the withdrawn length is then cut to a prescribed length to form a hosiery blank and the toe portion of the predetermined length is then sewn. The above sequence of steps generally has resisted automation because of the manual dexterity required to handle and orient a length of tubular knit fabric with respect to a sewing machine.

There have been earlier attempts at automatically handling a plurality of pre-cut hosiery blanks supplied from a series of knitting machines or other sources. Once such machine is described in U.S. Pat. No. 4,598,817 issued to Bell et al. However, the apparatus as taught by Bell is a complicated system which automatically orients hosiery blanks from a conveyor, selectively transfers the blanks from the conveyor to an assembly by means of a pickup assembly, sequentially conveys a plurality of the blanks to an automatic toe closing machine, evertes the blanks and sews the toe portion of the blanks. In addition, the apparatus as taught by Bell does not provide any means for withdrawing a portion of tubular knit fabric from a pre-knitted roll to form the pre-cut hosiery blanks.

Thus, there remains a need for a new and improved sewing apparatus which is operable to automatically withdraw a length of tubular knit fabric from a pre-knitted roll to form a hosiery blank, close the toe portion of the blank, and remove the sewn blank from the machine.

SUMMARY OF THE INVENTION

The present invention is directed to a sewing apparatus and method which receives tubular knit fabric from a pre-knitted roll of indeterminate length and makes the fabric into foot covers. The machine operates by first passing the fabric through an unique spreader which is mounted at the end of a pivotal boom adjacent a sewing machine. When the boom is swung away from the sewing machine, a gripping head advances to the spreader and grips the portion of the fabric held by the spreader. The gripping head than withdraws a predetermined length of fabric from the pre-knitted roll through the spreader. The gripping head releases the end of the fabric after moving slightly forward to reduce the tension on the length of tubular knit fabric. An air jet blows the free end of the length of tubular knit fabric into a vacuum take-off tube connected to a gathering box. The pivotal boom then swings toward the sewing machine. As the pivotal boom completes it swing, the tubular knit fabric is fed to the sewing machine which simultaneously sews the end immediately adjacent the spreader, cuts the free end from the pre-knitted roll, and gathers the finished product in the take-off tube. The pivotal boom then returns to its starting position and the cycle repeats, thereby forming a number of short, closed end lengths suitable as foot covers.

Accordingly, one aspect of the present invention is to provide a sewing apparatus for automatically producing sewn hosiery blanks from tubular knit fabric. The apparatus includes a supply means for supplying tubular knit fabric suitable for forming the hosiery blank; a sewing machine downstream of the supply means for sewing the end portion of the tubular knit fabric to form a hosiery blank; guide means located between the supply means and the sewing machine for receiving the tubular knit fabric from the supply means and positioning the end portion of the tubular knit fabric adjacent to the sewing head of the sewing machine; feeder means located downstream of the sewing machine for selectively engaging the end portion of the tubular knit fabric adjacent to the sewing head of the sewing machine and withdrawing a predetermined length of tubular knit fabric from the supply means; and control means connected to the guide means, the sewing machine and the feeder means for sequentially operating the guide means, the feeder means and the sewing machine, whereby sewn hosiery blanks are automatically formed.

Another aspect of the present invention is to provide an apparatus for continuously delivering tubular knit fabric from a supply means. The apparatus includes a generally elongated fabric support member adapted for receiving the open end of the tubular knit fabric; at least one pair of guide wheels mounted adjacent to opposite sides of one end of the fabric support member for engaging and supporting the edge portion of the fabric support member; and at least one pair of retaining wheels mounted to the edge portion of the support member adjacent to at least one of the pair of guide wheels mounted adjacent to the fabric support member, whereby the at least one pair of retaining wheels and at least one of the pair of guide wheels cooperate to support the support member while permitting the passage of the tubular knit fabric about the fabric support member.

Still another aspect of the present invention is to provide a sewing apparatus for automatically producing and gathering sewn hosiery blanks from tubular knit fabric. The apparatus includes supply means for supplying tubular knit fabric suitable for forming the hosiery blank; a sewing machine downstream of the supply means for sewing the end portion of the tubular knit fabric to form a hosiery blank; guide means located between the supply means and the sewing machine for receiving the tubular knit fabric from the supply means and positioning the end portion of the tubular knit fabric adjacent to the sewing head of the sewing machine; feeder means located downstream of the sewing machine for selectively engaging the end portion of the tubular knit fabric adjacent to the sewing head of the sewing machine and withdrawing a predetermined length of tubular knit fabric from the supply means; control means connected to the guide means, the sewing machine and the feeder means for sequentially operating the guide means, the feeder means and the sewing machine, whereby sewn hosiery blanks are automatically formed; and takeoff means located adjacent to the sewing machine for gathering the sewn hosiery blanks.

These and other aspects of the present invention will become apparent to those skilled in the art after a reading of the following description of the preferred embodiment when considered with the drawings.

BRIEF DESCRIPTION OF THE DRAWINGS

FIG. 4 is a further enlarged fragmentary top view of the blank guide assembly shown in FIG. 3, taken along lines 4—4;

FIG. 5 is an enlarged fragmentary side elevational view of the feeder assembly shown in FIG. 1;

FIG. 6 is block diagram of a control system suitable for the sewing apparatus constructed according to the present invention; and FIG. 7A-7E is a schematic side elevational view of the sequential steps in feeding, sewing, cutting and taking off a hosiery blank from sewing apparatus shown in FIG. 1.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
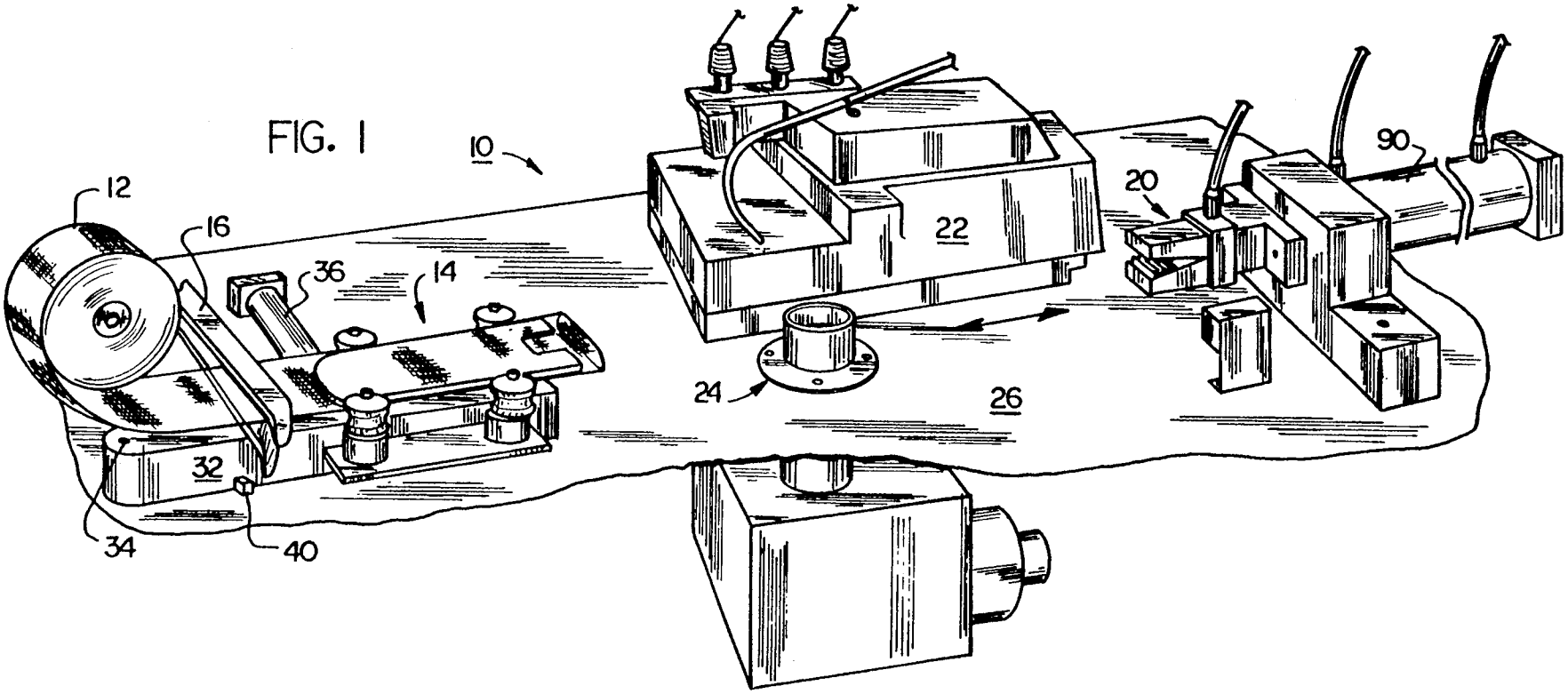
FIG. 1 is a schematic fragmentary perspective views of a sewing apparatus constructed according to present invention, including a blank guide assembly, a feeder assembly, and a take-off assembly.

Referring now to the drawings in general and FIG. 1 in particular, it will be understood that the illustrations are for the purpose of describing a preferred embodiment of the invention and are not intended to limit the invention thereto. As best seen in FIG. 1, a sewing apparatus, generally designated 10, is shown constructed according to the present invention. The sewing apparatus 10 includes three major subassemblies: a guide assembly 14, a feeder assembly 20, and a take-off assembly 24.

Tubular knit fabric supply 12 is first fed to guide assembly 14. A tension device 16 located between guide assembly 14 and the fabric supply 12 controls the feed tension. The tubular knit fabric supply 12 is manufactured by conventional means such as on a Model 411 circular weft knitting machine manufactured by Lonati of Italy. Feeder assembly 20 is located downstream of guide assembly 14. A conventional cut and sew sewing machine 22 is located between guide assembly 14 and feeder assembly 20. One model machine which has proved particularly suitable for use in this apparatus is a Model 39500 sewing machine manufactured by the Union Special Sewing Machine Company of Chicago, Illinois. Take-off assembly 24 is adjacent to and mounted thereon sewing machine 22.

Figure 2:
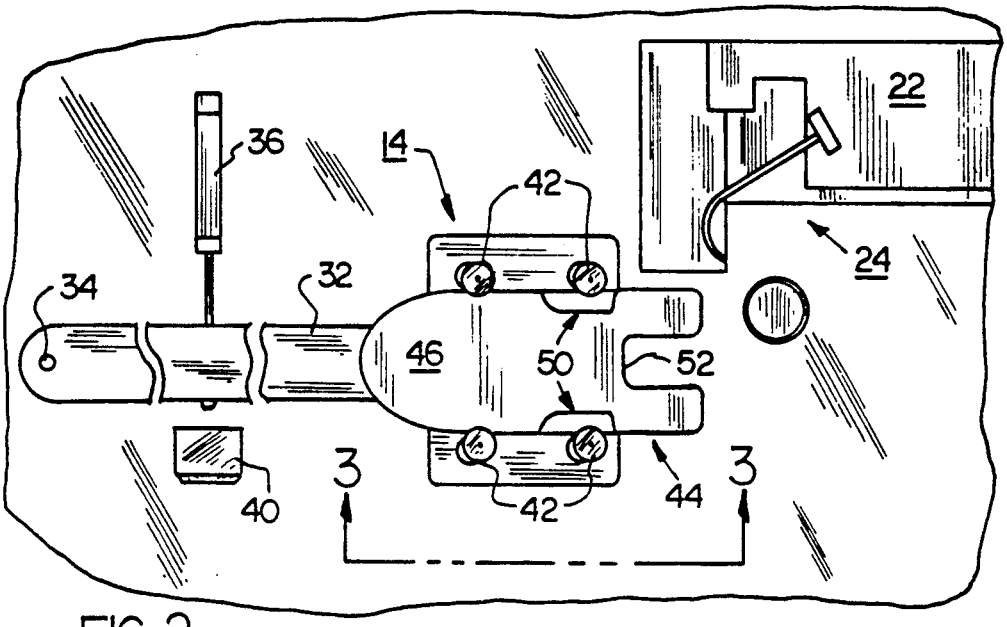
FIG. 2 is a top plan view of the blank guide assembly shown in FIG. 1 and a portion of the sewing machine.

Turning now to FIG. 2, there is shown a top plan view of the guide assembly 14 shown in FIG. 1 and a portion of the sewing machine 22. Guide assembly 14 includes a base 30 attached to one end of a pivotal boom 32. The other end of the pivotal boom 32 is attached to a pivot point 34 constructed to permit movement of the guide assembly 14 in a horizontal arc. A pneumatic cylinder 36 is located perpendicular to pivotal boom 32 and is operable to move boom 32 in the plane determined by pivot point 34. A microswitch 40 is located adjacent to the side of the boom 32 opposite the pneumatic cylinder 36 for providing a control signal indicative of the boom's position.

A plurality of guide wheel assemblies 42 are attached about the perimeter of base 30. A spreader plate assembly 44 is located therebetween the plurality of guide wheels assemblies 42. The spreader plate assembly 44 includes a generally planar plate 46 (i.e. fabric support member) having a pair of recessed retaining wheel assemblies 50 on opposite sides of the plate 46. Plate 46 also includes a slotted portion 52 at one end which cooperates with feeder assembly 20 to remove a predetermined length of tubular knit fabric as discussed below.

Figure 3:
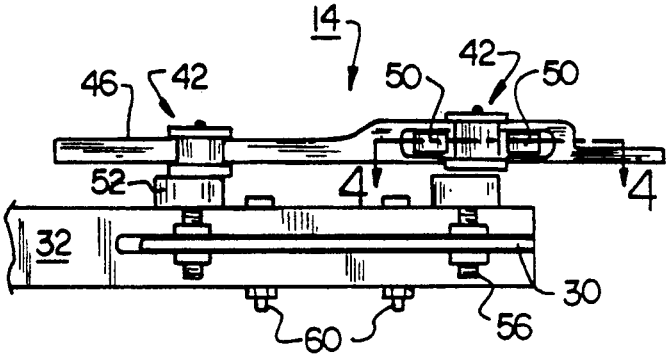
FIG. 3 is an enlarged fragmentary side elevational view of the blank guide assembly shown in FIG. 2, taken along lines 3—3, and a portion of the take-off assembly.
Figure 3:
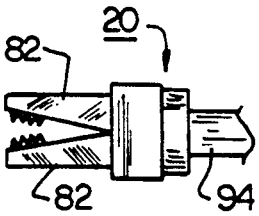

The unique operation of the guide assembly 14 can best be seen in FIG. 3 which shows an enlarged fragmentary side elevational view of the guide assembly shown in FIGS. 1 and 2 along with a portion of the feeder assembly 20. The plurality of guide wheels 42 are each mounted to individual eccentric mounts 54 which permit horizontal adjustment of the distance between each of the guide wheels 42 and the adjacent edge of plate 46 adjacent to each wheel. This adjustment permits minor dimensional changes which are sometimes necessary for different weights of tubular knit fabric since the tubular knit fabric is passed completely about the surface of the plate 46 and therefore passes between the edge of plate 46 and the surfaces of each of the plurality of guide wheels 42.

The eccentric mounts 54 are mounted to one end of threaded adjustment rods 56. The other end of each threaded adjustment rod 56 is attached to base 30. Threaded adjustment rods 56 permit the vertical height of plate 46 to be adjusted to cooperate with sewing machine 22 and feeder assembly 20. Threaded fasteners 60 pass through pivotal boom 32 to secure base 30 thereto.

As best seen in FIG. 4, each of the pair of recessed retaining wheels assemblies 50 cooperate with the adjacent guide wheel 42 to allow the tubular knit fabric to be stretched over and about plate 46 while, at the same time, retaining plate 46 in position. Adjacent to each pair of recessed retaining wheels assemblies 50 is a mounting plate 62 fastened to the upper surface of the plate 46 by fasteners 64 to define a cavity 66 for receiving assembly 50. The recessed retaining wheel assemblies 50 each includes a first retaining wheel 70 mounted on a shaft 72 and a second retaining wheel 74 mounted on shaft 76.

Retaining wheels 70,74 are chosen of a sufficient size and located in a position to engage the center portion of guide wheel 42 and to ride between retaining lips 78. Guide wheel 42 has two cylindrical lips and a cylindrical central portion extending therebetween, wherein the cylindrical central portion has a diameter less than the diameter of the cylindrical retaining lips. Sufficient play is left between wheels 70,74 and guide wheel 42 to permit the passage of tubular knit fabric 12 therebetween. However, sufficient contact is maintained between the surfaces of the pairs of retaining wheels 70,74 and guide wheels 42 to retain plate 46 in position. Thus, plate 46 acts as if it was of infinite length having the entire supply of tubular knit fabric 12 was positioned thereon. This structure enables the tubular knit fabric 12 to be continuously withdrawn from the guide assembly 14 without reloading until the tubular knit fabric supply 12 is depleted.

Turning now to FIG. 5, there is shown an enlarged fragmentary side elevational view of the feeder assembly 20 shown in FIG. 1. The feeder assembly 20 cooperates with the guide assembly 14 to allow a predetermined length of tubular knit fabric 12 to be withdrawn therefrom. The feeder assembly 20 includes a gripping head assembly 80 having a pair of opposed jaws 82. The inner surface of the jaws 82 have a plurality of bristles 84 on their opposed surfaces to provide frictional contact with the surface of the tubular knit fabric 12.

An actuator 86 adjacent to the opposed jaws 82 is pneumatically or electrically operated to open and close the jaws 82 in response to a control signal. In addition, the gripping head assembly 80 is attached to a two-way pneumatic cylinder 90. Cylinder 90 is attached to a bracket 92. Piston 94 extends therethrough bracket 92. A second microswitch 96 is located between the bracket 92 and the lower part of gripping head assembly 80 to provide a control signal indicative of the position of assembly 80.

A control system 100 suitable for use with the sewing apparatus 10 shown in block diagram in FIG. 6. The control system includes an electropneumatic computer 102 which is connected to guide assembly 14, feeder assembly 20 and sewing machine 22. One computer which has operated satisfactory is a Model 49400 5215 available from Schrader Bellows of Great Britain. Computer 102 is adapted to receive an air supply along line 104. Typically the air supply is in the range of about 30 psi. Air lines 106, 108, and 110 are connected between cylinders 36, 80, and 90, respectively, and computer 102. Control signals are received from microswitches 40,96 along lines 112 and 114, respectively to indicate the positions of guide assembly 14 and feeder assembly 20. An off/on control signal is sent to sewing machine 22 along line 116.

The operation of the guide assembly 14, feeder assembly 20 and the take-off assembly 24 may be best understood by referring to FIGS. 7A–7E which show a schematic side elevational view of the sequential steps in feeding, sewing, cutting and taking off a hosiery blank from the sewing apparatus 22 shown in FIG. 1. At the start of the cycle, pivotal boom 32 is positioned against first microswitch 40 and the gripping head assembly 80 is in its starting position between sewing machine 22 and second microswitch 96 (7A). First cylinder 90 is activated to extend gripping head assembly 80 forward and actuator 86 as engaged to close jaws 82 about the portion of the tubular knit fabric 12 stretched across slot 52 of plate 46 (7B). Gripping head assembly 80 then is withdrawn by cylinder 90 until head assembly 80 engages second microswitch 96 which stops backward movement of piston 94 (7C). After gripping head assembly 80 contacts microswitch 96, cylinder 90 is extended slightly to relieve the tension on the extended portion of tubular knit fabric 12 prior to opposed jaws 82 being opened to release the fabric (7D). This step reduces the tendency of the surface of the tubular knit fabric 12 to tear when bristles 84 are being disengaged from the surface thereof. After the free end of tubular knit fabric 12 is released by gripping head assembly 80, take-off assembly 24 operates to gather the free end into the gathering box (not shown) (7E). Pneumatic cylinder 36 is now engaged to pivot guide assembly 14 tangentially to sewing machine 22. Sewing machine 22 simultaneously sews seam and cuts the free end of the blank free in a conventional manner. The remaining cut and sewn portion of the tubular knit fabric 12 is sucked into the gathering box and pivotal boom 32 is repositioned against first microswitch 40 to begin a new cycle.

Certain modifications and improvements will occur to those skilled in the art upon reading of the foregoing description. By way of example, it is not necessary that the fabric be wound on a roll prior to being fed to the guide means. It should be understood that all such modifications and improvements have been deleted herein for the sake of conciseness and readability but are properly within the scope of the following claims.

We claim:

1. A sewing apparatus for automatically producing sewn hosiery blanks from tubular knit fabric, said apparatus comprising:

(a) supply means for supplying tubular knit fabric suitable for forming the hosiery blank;

(b) a sewing machine downstream of said supply means for sewing the end portion of the tubular knit fabric to form a hosiery blank;

(c) guide means located between said supply means and said sewing machine for receiving the tubular knit fabric from said supply means and positioning the end portion of the tubular knit fabric adjacent to the sewing head of said sewing machine;

(d) feeder means located downstream of said sewing machine for selectively engaging the end portion of the tubular knit fabric adjacent to the sewing head of said sewing machine and withdrawing a predetermined length of tubular knit fabric from said supply means;

(e) control means connected to said guide means, said sewing machine and said feeder means for sequentially operating said guide means, said feeder means and said sewing machine, whereby sewn hosiery blanks are automatically formed; and (f) takeoff means located adjacent to said sewing machine for gathering said sewn hosiery blanks.

2. The apparatus according to claim 1, wherein said feeder means located downstream of said sewing machine for selectively engaging the end portion of the tubular knit fabric adjacent to the sewing head of said sewing machine and withdrawing a predetermined length of tubular knit fabric from said supply means includes a jaw-like gripping head mounted to one end of a fluid operated cylinder, said gripping head and fluid operated cylinder cooperating to move said gripping head upstream adjacent to said guide means, to actuate said gripping head for engaging the end portion of the tubular knit fabric adjacent to the sewing head of said sewing machine, and to move said gripping head downstream away from said guide means, thereby withdrawing a predetermined length of tubular knit fabric from said supply means.

3. The apparatus according to claim 2, wherein said jaw-like gripping head includes a plurality of bristles mounted upon opposed surfaces of said gripping head for engaging the end portion of the tubular knit fabric adjacent to the sewing head of said sewing machine.

4. The apparatus according to claim 2, wherein said feeder means located downstream of said sewing machine for selectively engaging the end portion of the tubular knit fabric adjacent to the sewing head of said sewing machine and withdrawing a predetermined length of tubular knit fabric from said supply means further includes a positioning means located downstream of said gripping head for providing a control signal to said gripping head and fluid cylinder representative of the position of said gripping head, said gripping head and fluid cylinder cooperating to move said gripping head upstream prior to said gripping head being opened to release the end portion of the tubular knit fabric, thereby reducing the tendency of the end portion of the tubular knit fabric to tear when said gripping head is opened.

5. The apparatus according to claim 1, wherein said takeoff means located adjacent to said sewing machine for gathering said sewn hosiery blanks includes a gathering box, a vacuum source connected to said gathering box, and a conduit having one end connected to said gathering box and the other end mounted adjacent to said sewing machine.

6. The apparatus according to claim 5, wherein said takeoff means located adjacent to said sewing machine for gathering said sewn hosiery blanks further includes a source of compressed air adjacent to said sewing machine for directing a stream of air against the end portion of the tubular knit fabric adjacent to the sewing head of said sewing machine, thereby diverting the end portion of the tubular knit fabric into the vicinity of said conduit end mounted adjacent to said sewing machine, thereby facilitating the takeoff of said sewn hosiery blanks.

7. The apparatus according to claim 1, wherein said guide means located between said supply means and said sewing machine for receiving the tubular knit fabric from said supply means and positioning the end portion of the tubular knit fabric adjacent to the sewing head of said sewing machine includes a generally elongated fabric support member adapted for receiving the open end of the tubular knit fabric; at least one pair of guide wheels mounted adjacent to opposite sides of one end of said fabric support member for engaging and supporting the edge portion of said fabric support member; and at least one pair of retaining wheels mounted to the edge portion of said support member adjacent to at least one of said at least one pair of guide wheels mounted adjacent to said fabric support member, whereby said at least one pair of retaining wheels and at least one of said at least one pair of guide wheels cooperate to support said support member while permitting the passage of the tubular knit fabric about said fabric support member.

8. The apparatus according to claim 7, wherein said generally elongated fabric support member adapted for receiving the open end of the tubular knit fabric is a bullet-shaped plate having a first curved end and a second slotted end.

9. The apparatus according to claim 7, further including support means mounted adjacent to the other end of said fabric support member for engaging and supporting said fabric support member, wherein said support means and said at least one pair of guide wheels mounted adjacent to opposite sides of one end of said fabric support member for engaging and supporting the edge portion of said fabric support member cooperate to maintain said fabric support member within the horizontal plane determined by said support means and said at least one pair of guide wheels.

10. The apparatus according to claim 9, wherein said support means includes a second pair of guide wheels mounted adjacent to opposite sides of said fabric support member for engaging and supporting the edge portion of said fabric support member.

11. The apparatus according to claim 7, wherein each of said at least one pair of guide wheels mounted adjacent to opposite sides of one end of said fabric support member for engaging and supporting the edge portion of said fabric support member includes a center portion having a first diameter and a pair of shoulder portions adjacent to said center portion, each of said pair of shoulder portions having a second diameter greater than said first diameter, said center portion and shoulder portions cooperating to retain said generally elongated fabric support member.

12. The apparatus according to claim 7, wherein the diameter of each of said at least one pair of retaining wheels mounted to the edge portion of said support member adjacent to at least one of said pair of guide wheels mounted adjacent to said fabric support member is less than the corresponding diameter of said pair of guide wheels.

* * * * *